US007147729B2

(12) United States Patent
Chou et al.

(10) Patent No.: US 7,147,729 B2
(45) Date of Patent: Dec. 12, 2006

(54) METHOD AND APPARATUS FOR INDUCTION HEAT TREATING ELECTRICAL CONTACTS

(75) Inventors: George Jyh-Shann Chou, Mechanicsburg, PA (US); Bogdan Octav Ciocirlan, Middletown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/073,488

(22) Filed: Feb. 11, 2002

(65) Prior Publication Data

US 2003/0150531 A1 Aug. 14, 2003

(51) Int. Cl.
*C21D 1/10* (2006.01)

(52) U.S. Cl. ..... 148/526; 148/567

(58) Field of Classification Search ..... 148/518, 148/526, 568, 567

See application file for complete search history.

(56) References Cited

U.S. PATENT DOCUMENTS

| | | | | |
|---|---|---|---|---|
| 3,665,881 A | | 5/1972 | Koch et al. | |
| 4,188,419 A | * | 2/1980 | Detert et al. | 427/287 |
| 4,380,042 A | | 4/1983 | Angelucci, Sr. et al. | |
| 4,390,377 A | * | 6/1983 | Hogg | 148/518 |
| 5,238,650 A | | 8/1993 | Sheller et al. | |
| 5,350,467 A | | 9/1994 | Evans | |
| 6,093,267 A | * | 7/2000 | Arnaud et al. | 148/526 |
| 6,226,862 B1 | * | 5/2001 | Neuman | 29/830 |
| 2001/0009724 A1 | | 7/2001 | Chen et al. | |
| 2003/0115749 A1 | | 6/2003 | Chen | |

FOREIGN PATENT DOCUMENTS

| | | |
|---|---|---|
| FR | 2545104 | 11/1984 |
| JP | 11-289645 | * 10/1999 |
| WO | 98/21023 | * 5/1998 |

* cited by examiner

*Primary Examiner*—George Wyszomierski

(57) ABSTRACT

A method and apparatus are provided in accordance with embodiments of the present invention for heat-treating electrical contacts. The method and apparatus include plating a core wire with at least one conductive coating to form an electrical contact that experiences internal stresses. The method and apparatus further include induction heating the electrical contact for a predetermined period of time to at least partially relieve the internal stresses. A plurality of electrical contacts may be mounted on a substrate that is held near induction coils to cause heating. The electrical contacts may be formed with spring shaped bodies that are aligned at a desired orientation within magnetic fields created during induction heating. In accordance with at least one embodiment of the present invention, different portions of each electrical contact may be annealed by different desired amounts. The electrical contacts are annealed such that a base portion of each electrical contact undergoes less annealing to retain superior strength properties and the flexible portion of the electrical contact which retains superior stress-relaxation properties.

21 Claims, 11 Drawing Sheets

METHOD AND APPARATUS FOR INDUCTION HEAT TREATING ELECTRICAL CONTACTS

BACKGROUND OF THE INVENTION

Certain embodiments of the present invention generally relate to methods and apparatus for heat treating electrical contacts and, more particularly, for induction heating plated spring type micro contacts mounted in a substrate.

Electrical components are constructed today with numerous types of electrical contacts for varied applications. In certain applications, components such as processors and the like are plugged into sockets that are mounted on a circuit board. Contacts on the component are joined with contacts in the socket or on the circuit board. As technology advances, the size of both the components and the contacts decreases. In addition, it has become increasingly important to locate more contacts in a smaller area on the component, socket and circuit board, while improving the signal performance characteristics.

Certain applications use a socket and component combination that permits the component to be removed and/or replaced periodically from a circuit board or another power and data signal carrying structure. The components and sockets are formed with corresponding arrays of mating contacts. By way of example, the array of contact in the socket may be spring contacts that flex to form a mating interface with the mating contacts of the components.

Contacts are formed from a variety of processes and materials depending upon the characteristics that the contact must possess. For certain applications, the contacts are constructed with a core wire that is highly conductive, such as a gold wire, where the core wire is plated with an alloy material, such as nickel and the like that provides the strength of the contact, such as through plating of nickel alloy and the like. The contact may further be plated with another alloy material, such as gold alloy, to enhance the electrical contact properties and/or for corrosion protection. The core wire may be coated through any of a variety of plating processes, such as sputtering, electroplating, electroforming, chemical vapor deposition and the like. Once the core wire is coated, a plated electrical contact is formed.

However, once coated, the contact may experience unstable mechanical properties that break down at elevated temperatures. In particular, the plating process forms a series of coating layers that have a layered microstructure. The layered microstructure after plating resides in a non-equilibrium state. The layered microstructure of the nickel alloy and the like exhibits internal stresses within and between the coating layers of the contact. These internal stresses are also referred to as "residual stresses." The internal stresses increases the overall strength properties of the contact. However, the internal stresses cause the contact to exhibit inferior stress-relaxation properties when the contact becomes heated. The stress-relaxation properties refer to the ability of the contact over a period of time to maintain the required contact normal force and/or to return to and retain its original shape after the contact is placed under a load during numerous operation cycles. It is desirable to maintain high normal forces when the contact is placed under a load to ensure low contact resistance during use.

The stress-relaxation properties should be considered in applications where contacts in a socket mate with contacts in a component. The mating contacts are placed under a load that bends the contacts. During operation, the contacts carry power or data signals which creates a certain amount of heat.

The contacts are also heated by heat transfer from the surrounding electrical components. When the layered microstructure of the contact is heated, the internal stresses within the microstructure cause the microstructure to realign or recrystalize in an attempt to reach an equilibrium state. If the microstructure is recrystalized to an equilibrium state while in a loaded and bent position, the contact loses the ability to maintain the required contact normal force and/or to return to its original unloaded shape. Hence, the contact exhibits an inferior stress-relaxation property in that the force exerted by the socket contact upon mating with a component contact is reduced which leads to an inferior connection and poor signal performance.

In the past, once the contacts were plated, the contacts were heat treated prior to use in order to improve the stress-relaxation properties. The heat treatment process, also referred to as annealing, involves heating the contacts, after plating, to an elevated temperature for an extended period of time. Annealing enables the microstructure to recrystalize and reorganize into an equilibrium state, meanwhile relieving the internal stresses. The annealing process is carried out while the contact is without a load and therefore the contact remains in its original un-bent shape. Subsequent heating of the contact during use does not cause further recrystalization and thus does not degrade the stress-relaxation properties of the contact.

In the past, ovens have been used to anneal contacts that have been electroplated with nickel. In order to ensure that the oven relieves the internal stresses within the contact, the annealing process continued for a relatively long period of time at a relatively high temperature. For example, to anneal wrought or cast nickel alloys, the oven may be heated to 700° C. for hours.

In certain applications, the contacts are preformed or loaded onto a substrate before the annealing process is carried out. Consequently, the substrate must be able to withstand the temperatures in the oven for the period of time set for annealing. The substrate must be composed of materials that are capable of withstanding the annealing process. The options for substrate materials are limited and therefore relatively expensive. Accordingly, the oven can only be heated to a temperature that the substrate can withstand. In applications heating the substrate, the oven cannot be heated to 700° C. since even high grade substrates break down at such high temperatures. An annealing process is needed that enables lower temperature substrates to be used with the contacts.

In addition, conventional annealing processes utilize isothermal ovens that maintain a uniform temperature throughout the oven. Consequently, as contacts are heat-treated in the oven, the entire contact is uniformly heated. While the annealing process improves the stress-relaxation properties of the contact, the annealing process somewhat reduces the overall strength of the contact. Consequently, ovens that uniformly heat the entire contact equally reduce the strength of the entire contact.

In certain applications, it would be advantageous if different portions of the contact exhibit different mechanical properties. For example, certain portions of a contact may undergo a majority of the bending or flexing within the contact, while other portions of the contact do not bend at all. Consequently, the portions of the contact that bend should exhibit desirable stress-relaxation properties; that is, the bending portion of the contact should be able to provide the required contact normal force and/or to return to its original shape even after numerous mating and unmating cycles. Other portions of the contact may never bend, yet experience a significant amount of stress as the contact is placed under a load. For instance, the base portion of a contact may never bend, but it will experience substantial stress where the base portion secures the contact to a connector, substrate or other structure. It is preferable that the portion of the contact experiencing the greatest stress exhibit superior strength properties, with less concern for the stress-relaxation properties in this particular portion of the contact. Otherwise, the base portion may fracture and experience cracking during numerous mating and unmating cycles. Conventional annealing processes uniformly heat the contacts and thus the entire contact exhibits common strength properties and common stress-relaxation properties.

A need exists for a method and apparatus to anneal certain portions of a contact more than other portions of the same contact. A need remains for an improved heat treatment process and an apparatus that overcomes the disadvantages noted above and experienced in the prior art.

BRIEF SUMMARY OF THE INVENTION

A method and apparatus are provided in accordance with embodiments of the present invention for heat treating electrical contacts. The method and apparatus include plating a core wire with at least one conductive coating to form the skeleton of an electrical contact that experiences internal stresses. The method and apparatus further include heating the electrical contact by electromagnetic induction for a predetermined period of time to at least partially relieve the internal stresses. A plurality of electrical contacts may be mounted on a substrate that is held near induction coils to cause heating of the contacts. The electrical contacts may be oriented by rotating the micro contact component until the spring shaped bodies align with a desired orientation within the magnetic field generated by the induction coils.

In accordance with at least one embodiment of the present invention, different portions of each electrical contact may be annealed by different desired amounts. The electrical contacts are annealed such that a base portion of each electrical contact undergoes less annealing to retain superior strength properties and the flexible portion of the electrical contact which retains superior stress-relaxation properties/undergoes more annealing to fortify its stress-relaxation properties.

Figure 1:
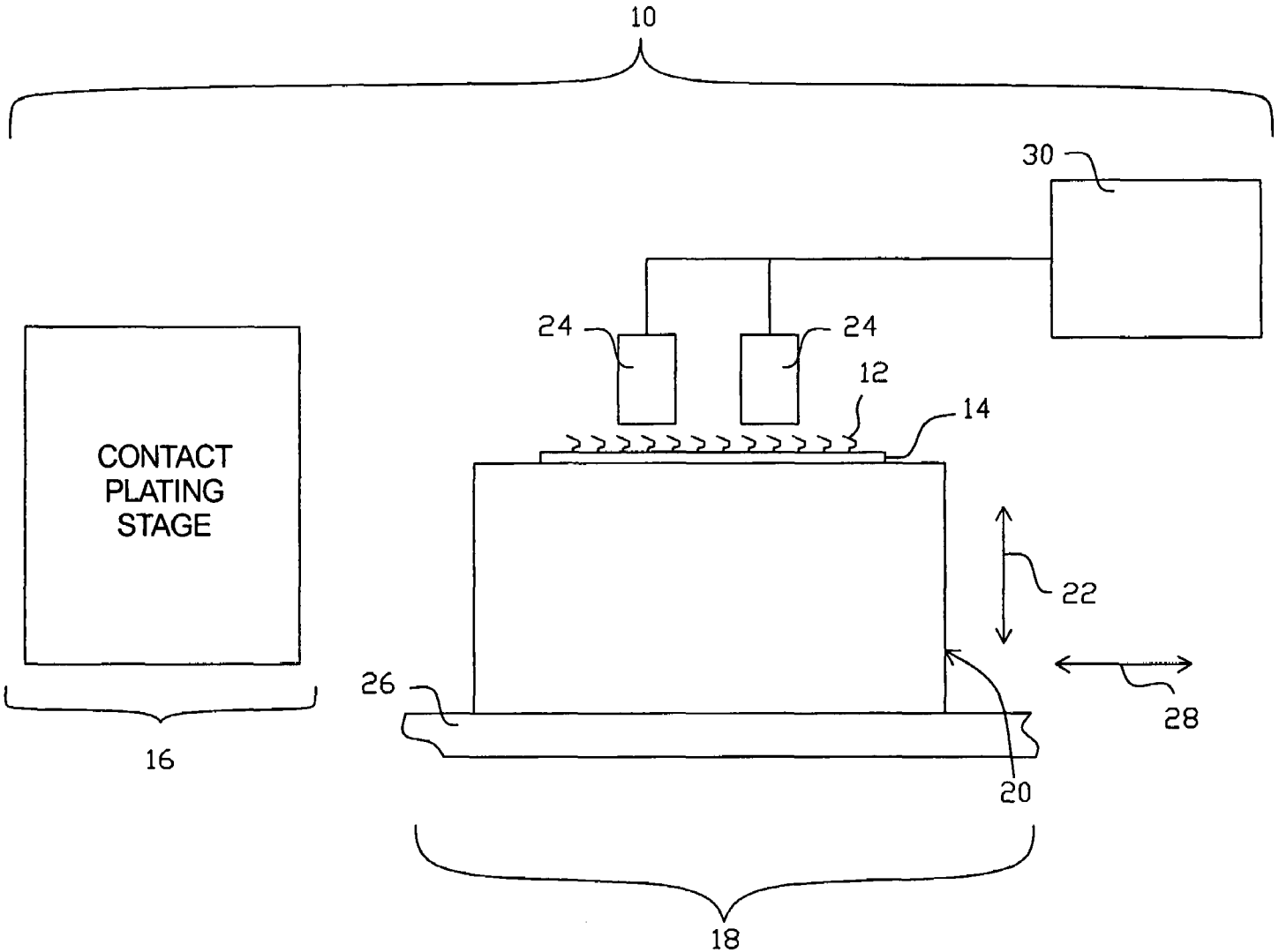
FIG. 1 illustrates an apparatus for forming electrical contacts in accordance with an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentality shown in the attached drawings.

DETAILED DESCRIPTION OF THE INVENTION

FIG. 1 illustrates an apparatus 10 for heat treating electrical contacts 12, such as metallic microcontacts that are used in a variety of applications. The electrical contacts 12 are mounted upon a substrate 14 that may be formed from numerous polymers and/or compositions. The apparatus 10 includes at least a contact plating stage 16 and a contact annealing stage 18.

The contact annealing stage 18 includes one or more induction coils 24. The induction coils 24 are powered by a power supply 30 to generate time-varying magnetic fields that surround the induction coils 24 and pass through a designated annealing area immediately adjacent to the induction coils 24. The magnetic fields induce heat in the electrical contacts 12. A movable fixture 20 is aligned parallel to the induction coils 24 and passes through the contact annealing stage 18.

The electrical contacts 12 and substrate 14 are held upon a fixture 20 that rides on the platform 26 at least during the contact annealing stage 18. The platform 26 and fixture 20 may include an air bearing therebetween. The air bearing may be created by a compressed air source. The fixture 20 is capable of adjusting the electrical contacts 12 and substrate 14 in a vertical direction indicated by arrow 22 to place the electrical contacts 12 a desired distance from the induction coils 24. The fixture 20 is also programmable to move the electrical contacts 12 in a conveyance direction denoted by arrow 28 and in a lateral direction, that is perpendicular to both the vertical direction 22 and the conveyance direction 28. While a single substrate 14 is shown on the fixture 20, multiple substrates 14 may be placed on the fixture 20 simultaneously.

Optionally, the platform 26 may be used to move the electrical contacts 12 during one or both of the contact plating and annealing stages 16 and 18. Optionally, the fixture 20 and platform 26 may not be used during the contact plating stage 16. A discontinuity is shown at an upstream end of the fixture 20 to illustrate that other intermediate processes or stages may be carried out between the contact plating stage 16 and contact annealing stage 18.

One exemplary sequence for producing a microcontact socket involves 1) making a substrate; 2) bonding and forming a core wire to the substrate; 3) passing the core wire and substrate through the contact plating stage 16; 4) passing the plated contact and substrate through the contact annealing stage 18; 5) subsequent processing; and 6) final assembly.

During the contact plating stage 16, each electrical contact 12 is formed from a conductive core wire that is initially bent into a desired shape and subsequently coated with one or more alloy materials having desired properties. For instance, the core wire may be formed of a gold alloy that is coated with a nickel alloy to strengthen the overall structure of the electrical contact. Once the nickel alloy coating is applied, additional alloy materials, such as a gold alloy, may be coated over the nickel alloy coating to improve the conduction properties of the electrical contact and/or for corrosion protection. Once the desired coatings are applied to the core wire, the resulting structure constitutes electrical contact 12. The contact plating stage 16 may implement a variety of processes to add the various coatings to the core wire. These processes include, but are not necessarily limited to sputtering, electroforming, chemical vapor deposition, electroplating and the like.

Depending upon the coatings applied, the electrical contacts 12 produced in the contact plating stage 16 may have mechanical properties that are not stable, particularly at higher temperatures. Instead, the contact plating stage 16 may create internal stresses within and between core wire various coatings applied to the core wire. The internal stresses are relieved or at least partially reduced for all or selected portions of each electrical contact 12 during the contact annealing stage 18.

In the contact annealing stage 18, the electrical contacts 12 are induction heated through exposure to time-varying magnetic fields that induce heat into the electrical contacts 12 in a controlled manner as explained below in more detail. The substrate 14 is of such a material that it is insensitive to induction heating. Although, the substrate 14 may experience slight heating through heat transferred from the electrical contacts 12.

In general, the higher the internal stresses within the electrical contact 12, the lower annealing temperature or shorter annealing time that is required to achieve recrystalization or stress relief. The annealing time and temperature are related to one another to achieve a particular degree of annealing. Hence, a high annealing temperature used for a shorter annealing time will result in the same degree of annealing as a lower annealing temperature used for a longer annealing time. It is to be understood that the term "annealing temperature" is used generally to refer to both a single temperature or a range of temperatures experienced by an electrical contact 12 depending upon the structure of the contact annealing stage 18.

Figure 2:
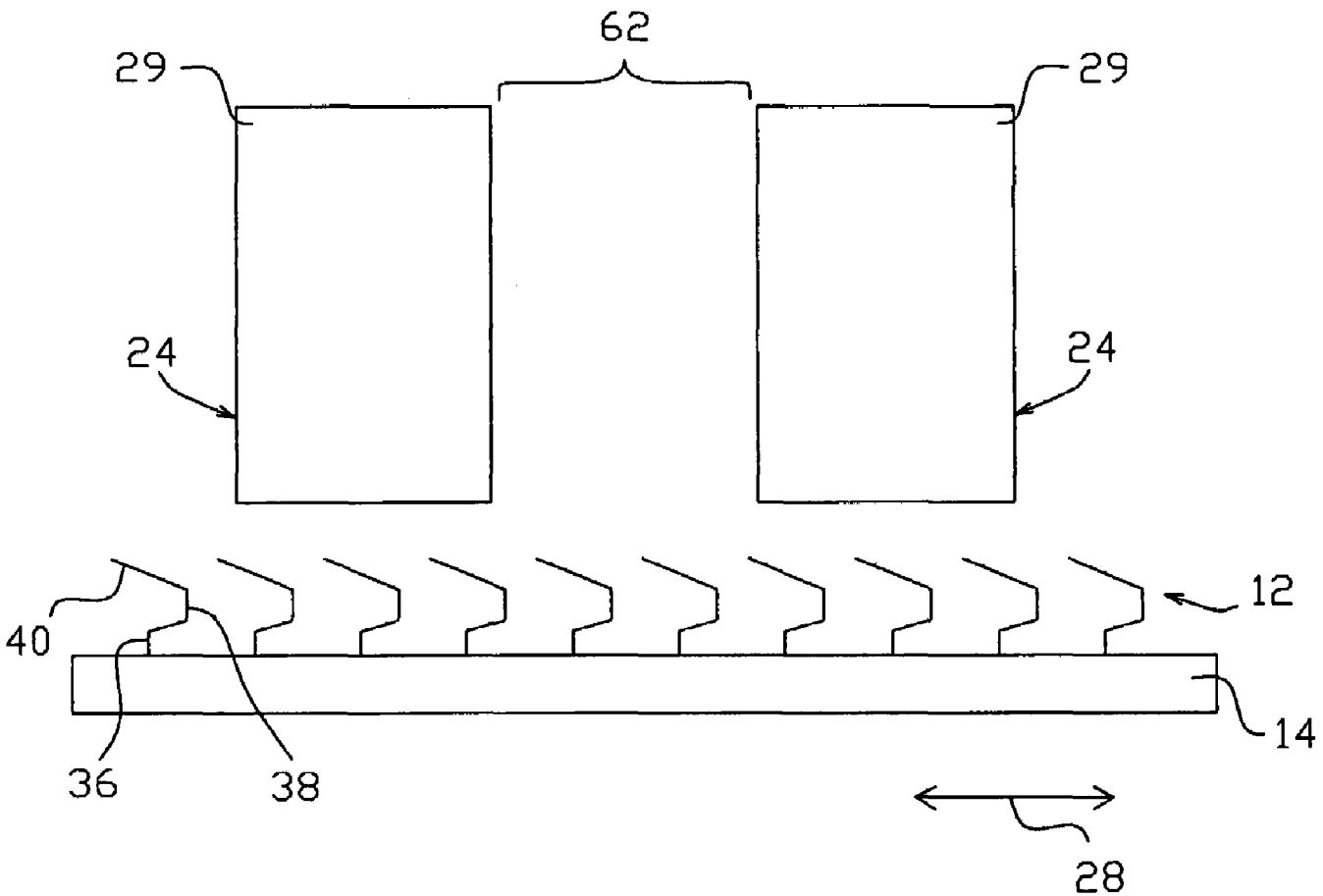
FIG. 2 illustrates a set of electrical contacts formed on a substrate.
Figure 3:
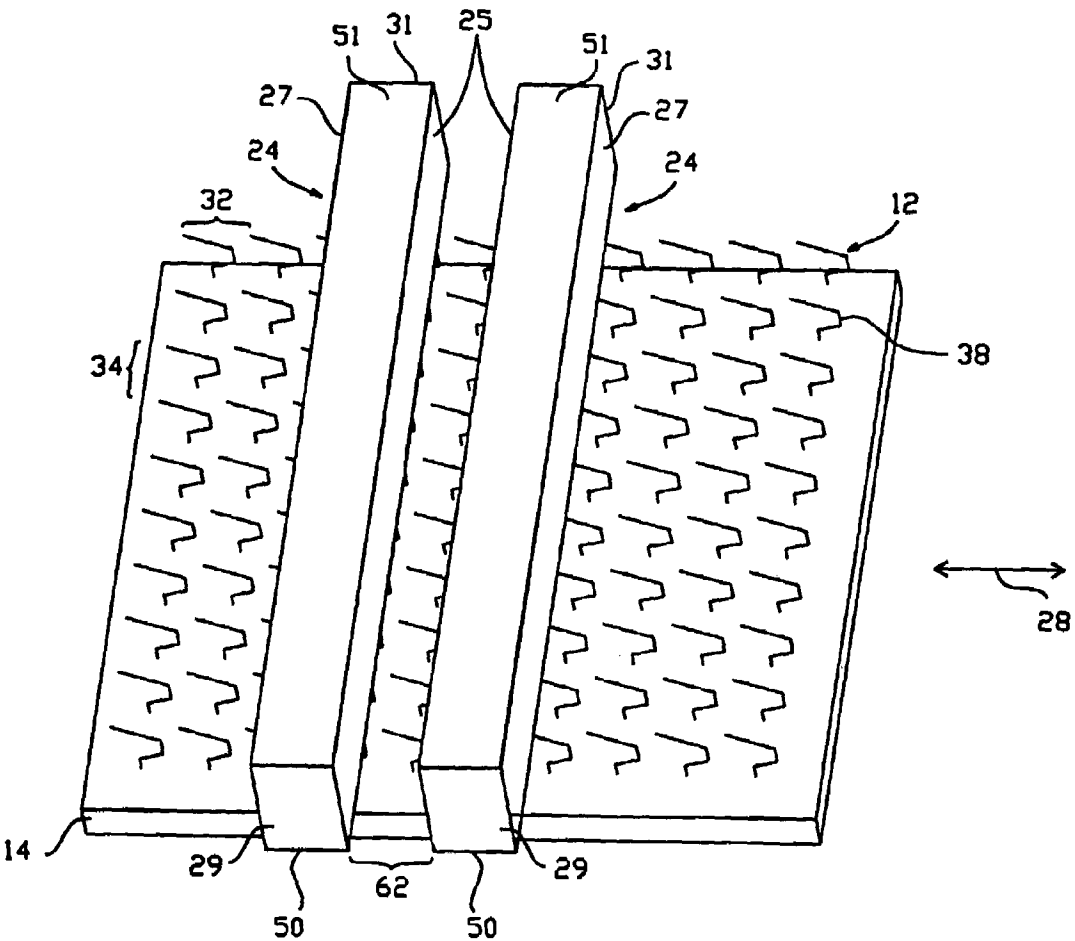
FIG. 3 illustrates a set of electrical contacts formed in a two-dimensional array on a substrate held proximate induction coils.

FIGS. 2 and 3 illustrate one configuration for mounting the electrical contacts 12 on the substrate 14. As shown in FIG. 3, a two-dimensional array of electrical contacts 12 is arranged in rows 32 and columns 34.

FIG. 3 illustrates the relation between the electrical contacts 12 and the induction coils 24 in more detail. The induction coils 24 may be formed as long rectangular tubes with interior facing sides 25 that are oriented parallel to one another and transverse to the conveyance direction 28. The induction coils 24 also include bottom surfaces 50, top surfaces 51, exterior sides 27 and opposed ends 29 and 31. The sides 25 are separated by a gap 62. In FIGS. 1 and 2, ends 29 of each induction coil 24 are illustrated. Ends 31 may be joined to form a single U-shaped induction coil 24. The induction coil 24 may also be round or circular in cross-section.

Figure 8:
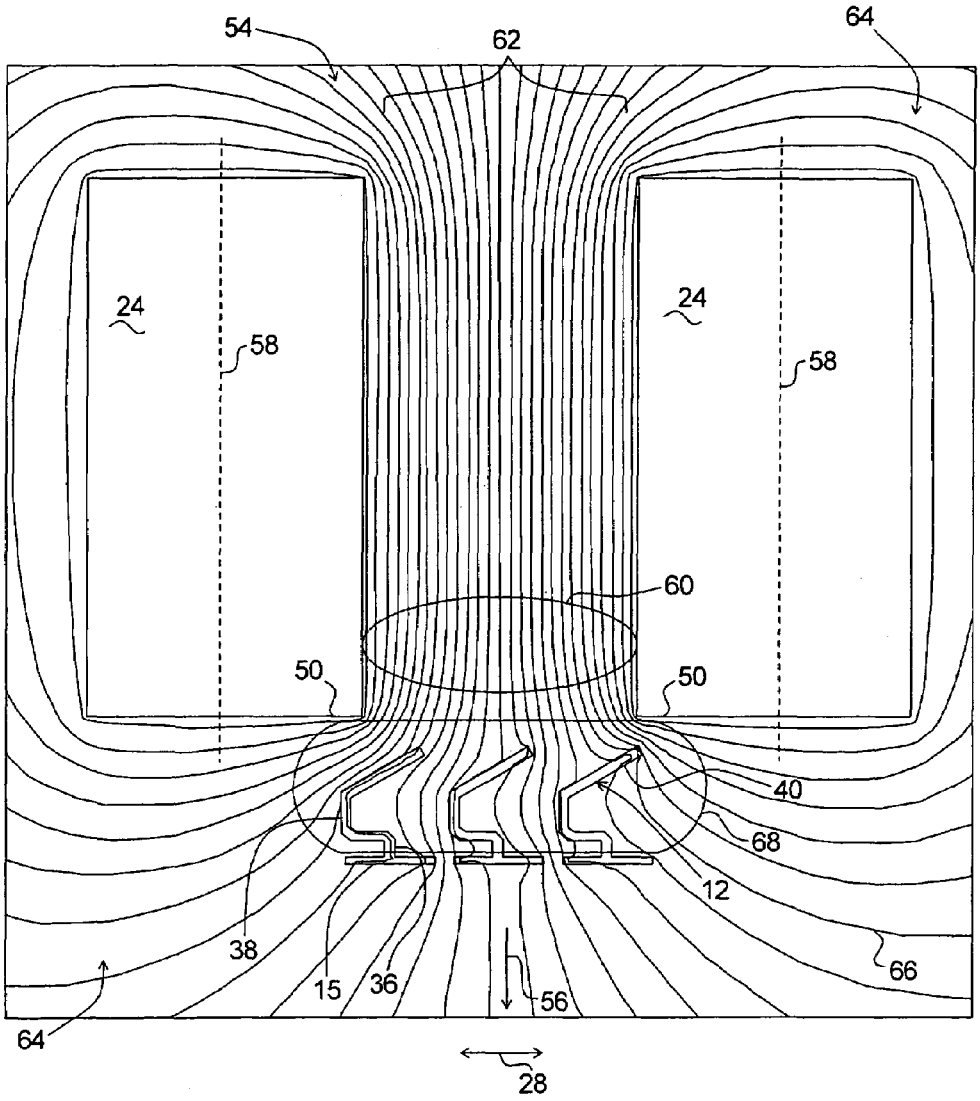
FIG. 8 illustrates the magnetic field distribution generated by induction coils in accordance with one embodiment of the present invention.

Cooling water may be passed inside the induction coil 24 to control their temperature. Opposite ends of the induction coil 24 are connected to the positive and negative terminals of a power supply. When the induction coil 24 is bent to form the U-shape, two parallel lines are formed. The parallel lines may be bent, thereby moving closer to, or further away from, one another in order to concentrate or defocus, respectively, the magnetic field intensity in the annealing region 68 (FIG. 8).

Figure 4:
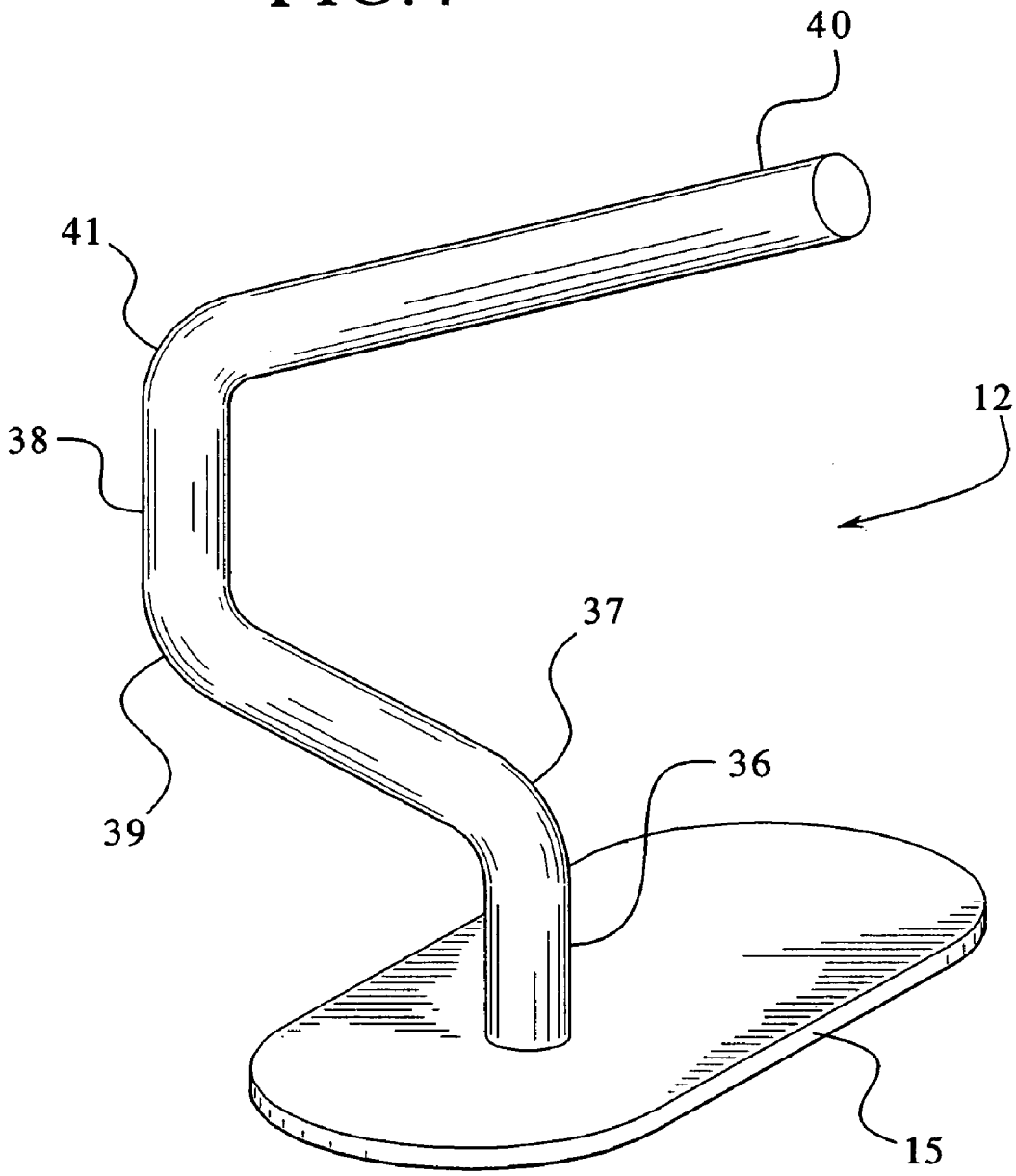
FIG. 4 illustrates an isometric view of an electrical contact to be annealed in accordance with an embodiment of the present invention.
Figure 5:
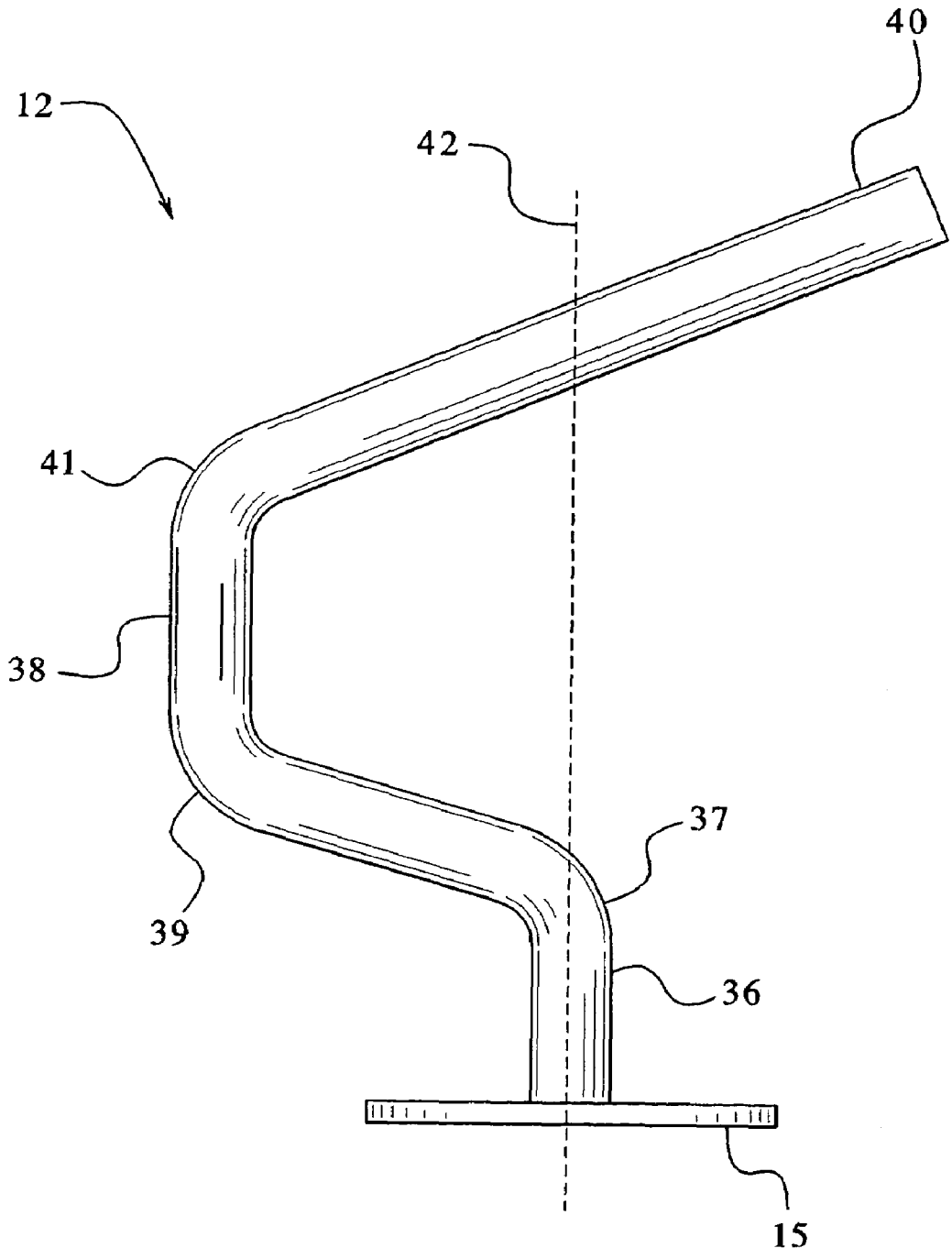
FIG. 5 illustrates a side view of the electrical contact of FIG. 4.
Figure 6:
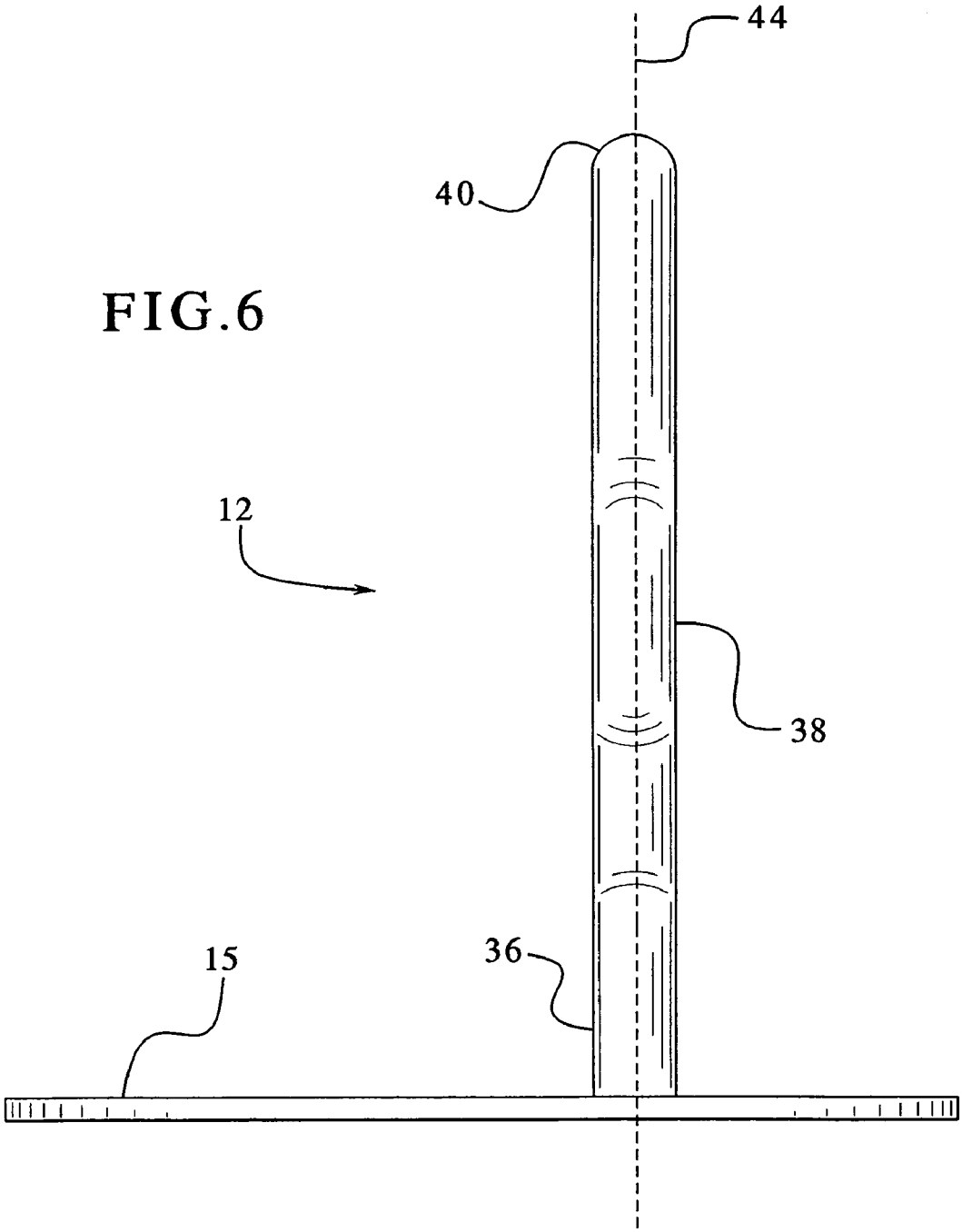
FIG. 6 illustrates an end view of the electrical contact of FIG. 4.

FIGS. 4–6 illustrate one shape for the electrical contacts 12. As shown in FIGS. 4–5, each electrical contact 12 includes a base portion 36 joined to a pad 15 embedded in substrate 14. Each base portion 36 extends from the pad 15 and is bent to form corners 37 and 39 and a knee portion 38. The knee portion 38 is bent to form a corner 41. The contact terminates at an upper tip 40. In certain applications, the knee portion 38 and corners 39 and 41 may be flexible and afford superior stress-relaxation properties such that the knee portion 38 and corners 39 and 41 return to an original shape even after repeated bending in a high temperature environment. Each electrical contact 12 is formed about a central longitudinal axis 42 extending from a center of the base portion 36. The upper tip 40 intersects the longitudinal axis 42, while the knee portion 38 extends laterally from the longitudinal axis 42. Each electrical contact 12 is centered within a contact plane which is graphically illustrated in FIG. 6 as a line 44 extending upward above and downward below the electrical contact 12. The base portion 36, knee portion 38 and upper tip 40 are aligned to lie within the contact plane.

As shown in FIG. 3, the electrical contacts 12 are oriented on the substrate 14 in a common direction with knee portions 38 facing forward in the conveyance direction 28 (FIG. 1).

Figure 7:
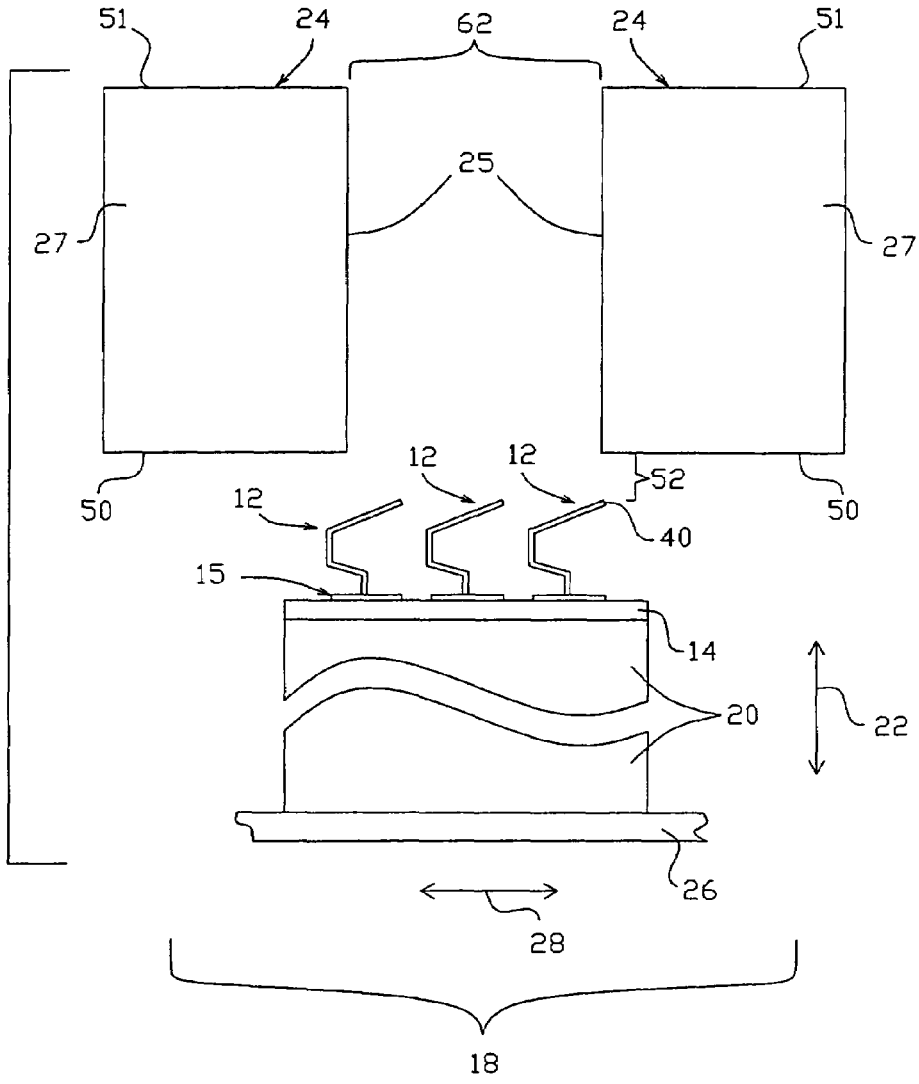
FIG. 7 illustrates an end view of the electrical contacts and the induction coils during the annealing process.

FIG. 7 illustrates a relation between the electrical contacts 12 and the induction coils 24 when passed through the contact annealing stage 18 along the conveyance direction 28. FIG. 7 only illustrates a portion of the fixture 20. The induction coils 24 are formed with a rectangular cross-section and spaced apart from one another by gap 62 to form a desired magnetic field distribution. The electric contacts 12 may be conveyed through the contact annealing stage 18 in various manners by fixture 20, such as continuously at a constant rate, continuously at a variable rate, indexed in a stepped manner and the like. The electrical contacts 12 may be moved along the bottom surfaces 50 of the induction coils 24 with the upper tips 40 located a constant predetermined contact-to-coil distance 52 below the bottom surfaces 50. During continuous movement, the electrical contacts 12 may be moved parallel to the bottom surfaces 50 while maintaining a constant contact-to-coil distance 52. Alternatively, the platform 26 may index the electrical contacts 12 in a stepped manner along the conveyance direction 28 to a desired position centered below the gap 62 between the induction coils 24. The fixture 20 may then move the electrical contacts 12 in conveyance direction 28 once the standoff between fixture 20 and the coils has been adjusted to the predetermined contact-to-coil distance 52. The platform 26 may be an x-y table with a boundary for monitoring the location and the travel of the fixture 20.

FIG. 8 illustrates a magnetic field distribution 54 formed of magnetic field lines 66 generated by the induction coils 24 carrying electric currents in opposite direction. The magnetic field distribution 54 includes an annealing area 68, through which magnetic field lines 66 from the field portion 60 of the magnetic field extends in a direction 56 substantially parallel to the vertical cross-sectional axes 58 of the induction coils 24. The magnetic field lines 66 are controlled to define an annealing area 68 extending from the bottom surface 50 of the induction coils 24 far enough to encompass the knee portions 38 of the electrical contacts 12. Hence, the fixture 20 is able to locate the knee portions 38 and upper tips 40 of the electrical contacts 12 in the annealing area 68. The annealing area 68 may be defined to exclude the pads 15, such as when the pads 15 are embedded in the substrate 14 (FIG. 2). It may be desirable (but not necessary) to locate the pads 15 outside of (below) the annealing area 68 to prevent undue heating of the pads 15. When the pads 15 are embedded in the substrate 14, undue heating of the pads 15 may adversely effect (e.g., burn or destroy) the substrate 14.

The electrical contacts 12 may be oriented at different angles and positions relative to the magnetic fields. For instance, the electrical contacts 12 may be oriented within the magnetic field distribution 54 such that the contact plane 44 (FIG. 6) is aligned parallel to the direction 56 of the field portion 60 and parallel to the conveyance direction 28. The electrical contacts 12 may also be oriented with the knee portions 38 facing in the conveyance direction 28 such that, during continuous movement, as each electrical contact 12 is moved along the conveyance direction 28 through the magnetic field distribution 54, the knee portion 38 is the first portion of each electrical contact 12 to experience induction heating.

The magnetic field lines 66 that passes by the electrical contacts 12 induces eddy currents within the electrical contacts 12. The induced eddy current flow in the electrical contact 12 with its inherent electrical resistance, causes heat to be generated within the electrical contact 12. The heat is localized to the portion of the electrical contact 12 experiencing the magnetic field lines 66. By way of example only, the localized portions of the electrical contacts 12 may be heated to 700° C. during annealing. Localized heating occurs since various portions of each individual electrical contact 12 are exposed to different magnetic field lines 66 that induce therein differing amounts of current flow. The amount of current flow at a particular portion of the electrical contact 12 is dependent, among other factors, upon the intensity of the magnetic field lines 66 experienced by an exposed portion of the electrical contact 12. Generally, current flow is also dependent upon the direction of the magnetic field lines 66 with respect to the cross-section area of the exposed portion of the electrical contact 12.

The magnetic fields exhibit a field intensity gradient, wherein the field intensity is strongest within and near the gap 62 between the induction coil 24 as compared to the field intensity in peripheral regions 64. The spacing between each magnetic field line 66 denotes the field intensity, with the field intensity being stronger in regions where the magnetic field lines 66 are closer to one another. The field intensity is greater in the annealing area 68 than in peripheral regions 64. As the magnetic field lines 66 continue in the direction 56 through the annealing area 68 away from the induction coil 24, the magnetic field lines 66 turn and separate. Hence, a field intensity gradient exists through the annealing area 68, with a strongest field intensity existing between and along the bottom surfaces 50 of the induction coils 24 and the gap 62. The field intensity continually weakens as the magnetic field lines 66 advance in the direction 56. Accordingly, the upper tips 40 of each electrical contact 12 experience more intense magnetic fields than experienced by the knee portions 38. Similarly, the knee portions 38 experience more intense magnetic fields than the base portions 36.

During the annealing process, the electrical contacts 12 are heated to an elevated temperature at which the internal stresses are relieved in and between the coatings plated on the core wire. As each electrical contact 12 is induction heated, the base portion 36, knee portion 38 and upper tip 40 experience magnetic fields of different intensity. Consequently, the base portion 36, knee portion 38 and upper tip 40 are heated to slightly different temperatures and undergo respective different amounts of annealing. By varying the temperature to which the base portion 36, knee portion 38 and upper tip 40 are heated, the apparatus 10 (FIG. 1) controls the degree to which the internal stresses are relieved. Hence, when it is desirable that the base portion 36 afford better strength properties, with less concern for bending and relaxation, less annealing is applied. Alternatively, more annealing is applied in the knee portion 38 where less strength is needed and better bending and relaxation properties are desired.

Figure 9:
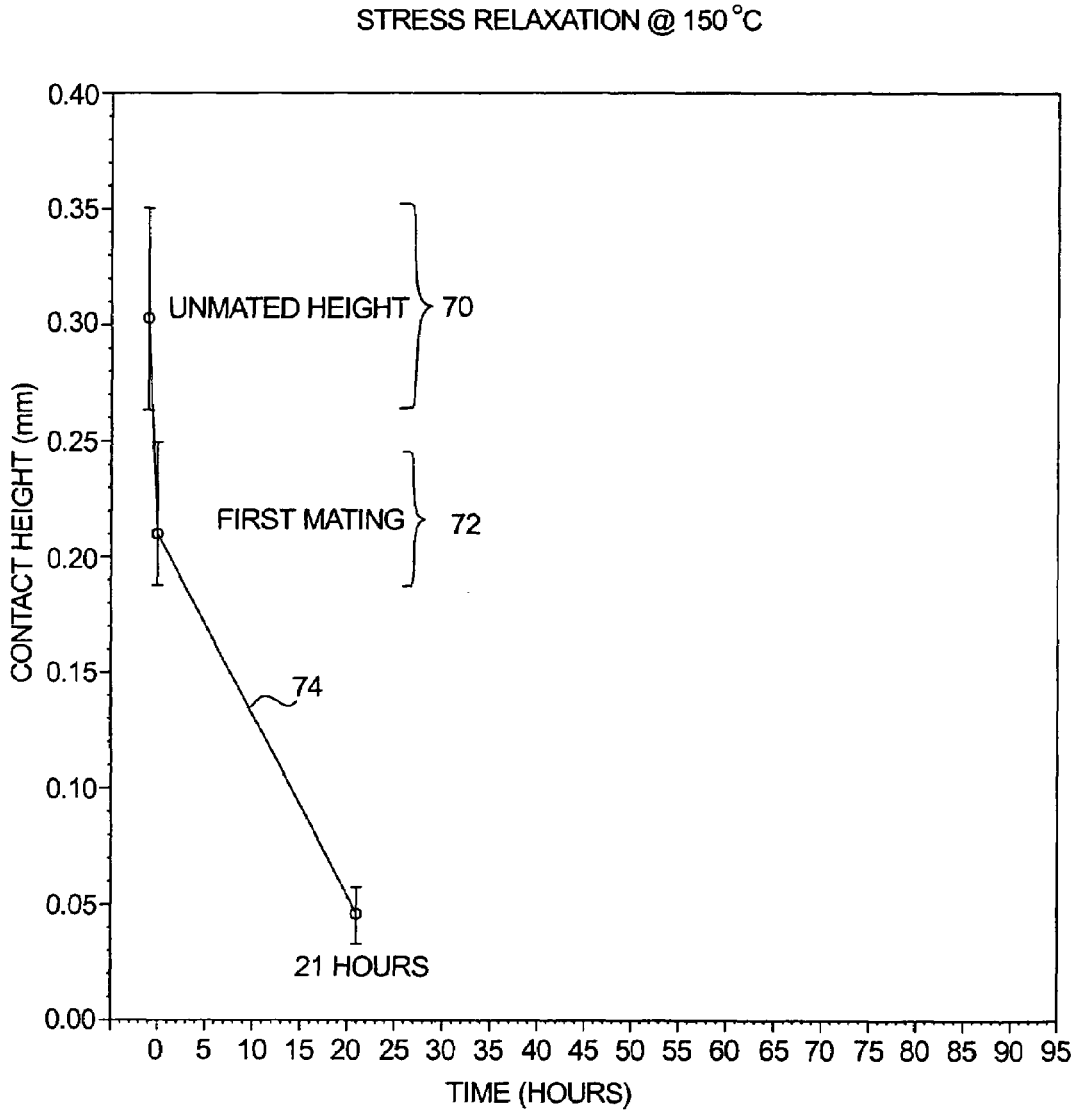
FIG. 9 plots stress relaxation data for a set of electrical contacts tested before being annealed.
Figure 10:
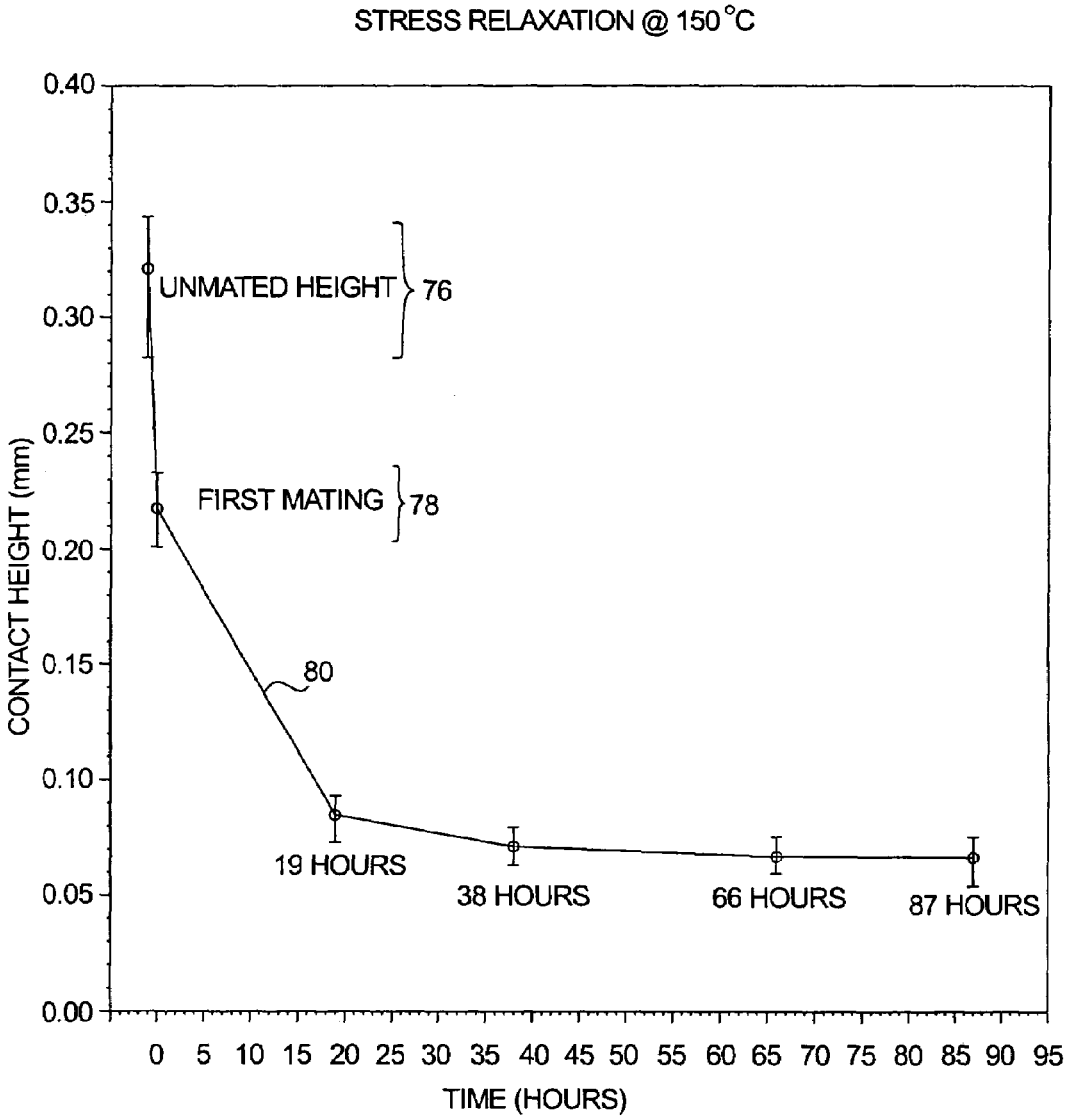
FIG. 10 plots stress relaxation data for a set of electrical contacts tested after being annealed in a conventional isothermal oven.
Figure 11:
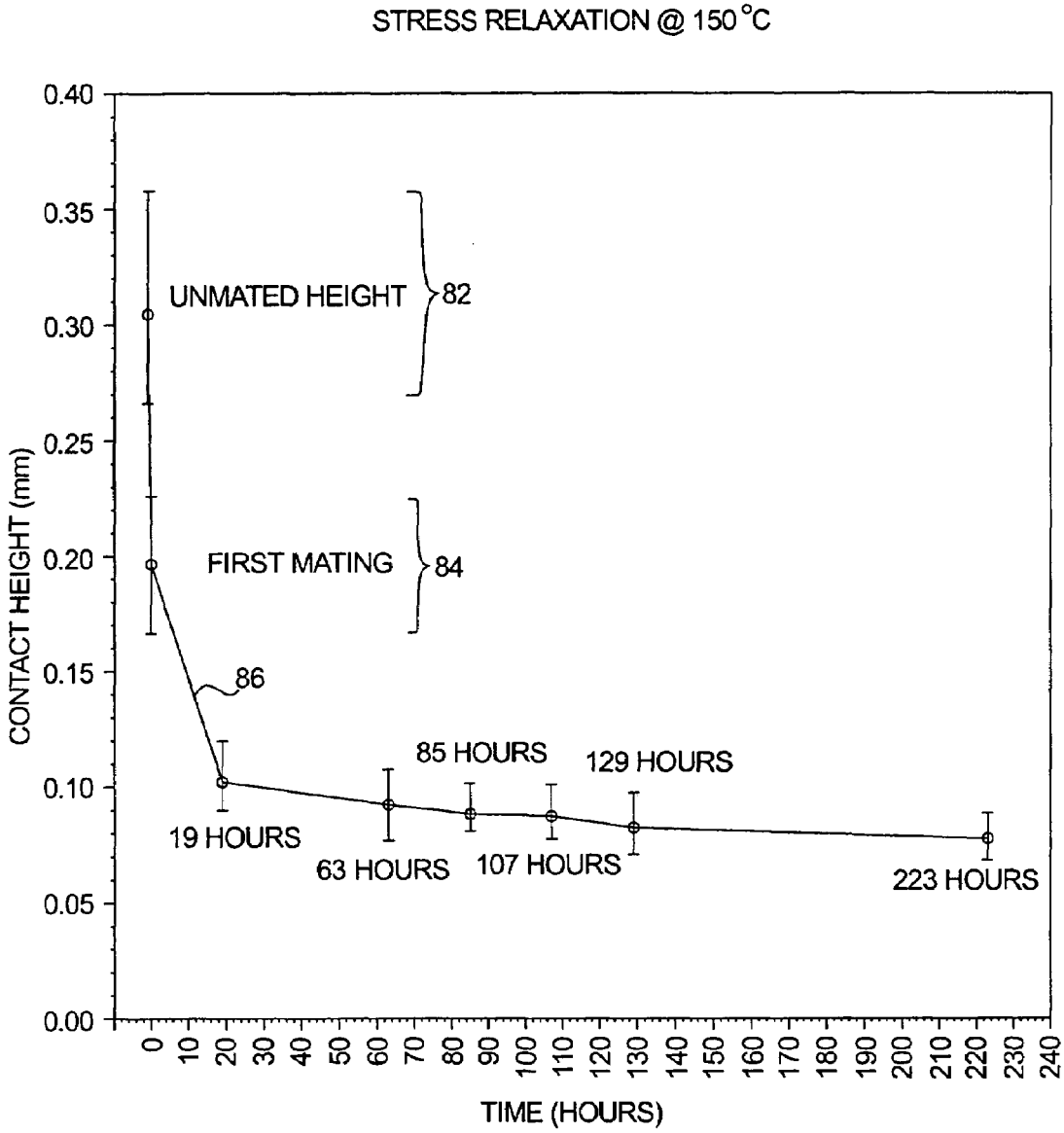
FIG. 11 plots stress relaxation data for a set of electrical contacts tested after being annealed in accordance with an embodiment of the present invention.

FIGS. 9–11 illustrate charts of the stress relaxation data of numerous electrical contacts 12 (FIG. 4). The stress relaxation data was collected by testing multiple electrical contacts 12 (FIG. 4). The tests involved heating the electrical contacts 12 to a predetermined temperature (e.g., 150° C.) and placing a load of predetermined weight on the upper tip 40. The overall height between the base portion 36 and the upper tip 40 for each electrical contact 12 was measured before the load was applied and at discrete time intervals following loading of the electrical contact 12. In FIGS. 9–11, the horizontal axis plots the time that elapsed since the electrical contacts 12 were first placed under the test load, while the vertical axis plots the height of the loaded electrical contacts 12 at the discrete times.

FIG. 9 plots the stress relaxation data for a set of electrical contacts 12 after the contact plating stage 16 (FIG. 1), yet before any annealing occurred. Region 70 represents a range for the initial height of the electrical contacts 12 before being loaded while region 72 represents the initial height to which the electrical contacts 12 were compressed immediately after the load was added. As indicated by graph 74, over a period of hours, the height of the electrical contacts 12 reduced. As shown in graph 74, the height changed substantially within the first 21 hours of testing.

FIG. 10 plots the stress relaxation data for a set of electrical contacts after being heated in a conventional isothermal oven, in which the entire body of every electrical contact 12 was uniformly heated and annealed throughout. Regions 76 and 78 represent the range of initial heights for the electrical contacts 12 while unloaded and immediately after being loaded, respectively. Graph 80 plots the change in the height of the electrical contacts 12 over time. As shown in graph 80, the height fell below 0.1 mm in the first 19 hours of testing.

FIG. 11 plots stress relaxation data for a set of electrical contacts 12 that were annealed using the contact annealing stage 18 (FIG. 1) in accordance with at least one embodiment of the present invention. Regions 82 and 84 indicate a range of heights for the tested electrical contacts 12 both before loading and immediately after loading, respectively. Graph 86 plots the change in height of the electrical contacts 12 over time. As shown in graph 86, the height remained at or slightly greater than 0.1 mm after 19 hours of testing.

By way of example only, the substrate 14 may be formed from the resin systems set forth below in Table 1. Table 1 sets forth the glass transition temperatures for one common type of glass fiber reinforced (FR-4) epoxy, as well as for polyimide epoxy, cyanate esters, polyimide and PTFE. The FR-4 Epoxy polymer is the least expensive of the listed resin systems, yet is unable to withstand the temperatures used in conventional isothermal ovens. Hence, FR-4 Epoxy has not been used in the past with electrical contacts 12 that undergo annealing. None of the materials in Table 1 are sensitive to time-varying magnetic fields and thus do not heat when in the presence of the time-varying magnetic fields. Consequently, even FR-4 Epoxy may be used in the contact annealing stage 18 (FIG. 1).

TABLE 1

| Resin System | Glass Transition Temperature ° C. | Glass Transition Temperature ° F. |
|---|---|---|
| FR-4 Epoxy | 125–135 | 255–275 |
| Polyimide Epoxy | 250–260 | 480–500 |
| Cyanate Esters | 240–250 | 465–480 |
| Polyimide | >260 | >500 |
| PTFE (melting point) | 327 | 620 |

The substrate 14 (FIG. 14) may be formed from other materials as well, provided that they are insensitive to the time-varying magnetic fields and are able to withstand radiant heat from the base portion 36 (FIG. 4).

Optionally, the electrical contact 12 may be oriented in a different direction and/or plane with respect to the magnetic fields within the annealing area 68. For instance, the electrical contact 12 may be oriented with the contact plane 44 aligned perpendicular to direction 56 (FIG. 8), such as when it is desirable to uniformly anneal the entire electrical contact 12.

As noted above, the electrical contacts 12 may be advanced through the contact annealing stage 18 in a continuous manner at a constant or variable conveyance rate. For instance, when advanced at a variable conveyance rate, the electrical contacts 12 may be moved at a fast rate through lead-in and exit portions of the contact annealing stage 18, and at a slow rate through the annealing area 68. Moving the electrical contacts 12 at a variable conveyance rate enables the fixture 20 to position each electrical contact 12 for a longer period of time at the point in the magnetic field distribution 54, of the strongest field intensity.

Optionally, a single induction coil or more than two induction coils may be used to vary the shape and intensity of the magnetic field distribution 54.

Optionally, different portions of an electrical contact may be plated with different materials and/or a different number of layers of alloys or other material, thereby forming an unevenly plated contact. The unevenly plated contacts may be oriented with respect to the magnetic field distribution 54, such that the different materials/layers are exposed to different magnetic field intensities.

Optionally, the apparatus 10 may induction heat other structures besides electrical contact, such as any other portion of an electrical connector.

Optionally, a controlled environment of an inert gas may be formed around the annealing area 68 to protect the electrical contacts 14 from oxidation during the annealing process. Optionally, a ferrite magnetic sheet material may be placed underneath of the substrate 14 (separate from or as part of the platform 26) to shape the magnetic field lines 66 that the induction coil 24 produces in order to evenly heat each and every electrical contact 12 to a desired temperature with a desired amount of uniformity between the electrical contacts 12 held by a particular substrate 14. It is understood that a few or hundreds or even thousands of electrical contacts 12 (e.g., microcontacts) may be embedded within each substrate 14 used to form a socket.

By way of example only, the induction coils 24 may be driven by a 1 kw power supply with a signal having a frequency in the range of 10–15 MHz. By way of example only, the electrical contacts 12 may be formed as microcontacts having diameters of approximately 0.1 mm and an overall height of approximately 1.0 mm. The temperature within the annealing area 68 may be varied by adjusting the magnetic field intensity, magnetic field frequency, standoff distance between the electrical contacts 14 and the induction coils 24, annealing time, conduction cooling and geometry for the particular electrical contacts.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A method of forming an electrical contact, comprising:

mounting a plurality of electrical contacts on a substrate;

induction heating the electrical contacts for a predetermined period of time to heat different first and second portions of each of the electrical contacts by different first and second amounts;

generating time-varying magnetic fields within an annealing region extending in a substantially parallel field direction; and orienting the electrical contacts during said induction heating step, such that a plane containing each of the electrical contact is parallel to the field direction.

2. The method of claim 1 wherein said induction heating step heats the first portion of each of the electrical contacts such that the first portion exhibits superior strength properties as compared to the second portion and heats the second portion such that the second portion exhibits superior stress-relaxation properties as compared to the first portion.

3. The method of claim 1, further comprising: shaping the electrical contacts to include a base portion and knee portion aligned within a common contact plane; and passing each of said electrical contacts through a magnetic field created in the induction heating step with the contact planes being aligned parallel to a direction of the magnetic field.

4. The method of claim 1, further comprising shaping each of the electrical contacts with a flexible portion extending forward from a base portion of the electrical contact, and orienting the electrical contacts such that the flexible portion enters magnetic fields created during the induction heating step before the base portion enter the magnetic fields.

5. The method of claim 1, further comprising: orienting the electrical contacts such that one end of each of the electrical contacts is exposed to higher intensity magnetic fields created during the induction heating step and such that an opposite end of each of the electrical contacts is exposed to weaker intensity magnetic fields.

6. The method of claim 1, further comprising, during the induction heating step, passing the electrical contacts through a magnetic field having a field intensity gradient extending along a length of each of the electrical contacts.

7. The method of claim 1, wherein the induction heating step includes creating a time-varying magnetic field having a field intensity gradient extending in a first direction, and passing the electrical contacts through said magnetic field in a conveyance direction perpendicular to said first direction.

8. The method of claim 1, wherein the mount step includes aligning each of the contacts along a contact longitudinal axis that extends away from a plane containing the substrate.

9. The method of claim 1, further comprising: shaping the electrical contact to include a base portion and knee portion aligned within a common contact plane.

10. A method of forming an electrical contact, comprising:

mounting a plurality of electrical contacts on a substrate; and induction heating the electrical contacts for a predetermined period of time to heat different first and second portions of each of the electrical contacts by different first and second amounts, wherein said induction heating step includes generating a time-varying magnetic field through which the electrical contacts are continuously moved.

11. A method of forming an electrical contact, comprising:

mounting a plurality of electrical contacts on a substrate; and induction heating the electrical contacts for a predetermined period of time to heat different first and second portions of each of the electrical contacts by different first and second amounts, wherein said induction heating step includes generating a magnetic field through which the electrical contacts are indexed in a stepped manner.

12. A method for fabricating a contact component, comprising:

mounting a plurality of contacts onto a substrate, said substrate being insensitive to magnetic fields;

induction heating of each said contacts by different first and second amounts without induction heating said substrate; and orienting said plurality of contacts such that a contact plane of each of said contacts is parallel to a direction of magnetic fields created during said induction heating step.

13. The method of claim 12 further comprising orienting said plurality of contacts such that a central flexible portion of each of said contacts first entering an induction field created during said induction heating step before a remaining portion of each of said contacts enters the induction field.

14. The method of claim 12, wherein said induction heating step includes reducing internal stresses in each of the contacts by a first amount in first portions of each contact and by a different second amount in second portions of each of said contacts, such that the first portion of each of the micro contacts exhibits superior strength properties as compared to the second portion, while the second portion of each of the contacts exhibits superior stress relaxation properties as compared to the first portion.

15. The method of claim 12, wherein said induction heating step includes generating a time-varying magnetic field extending in a field direction and passing said contacts through said magnetic field along a conveyance direction perpendicular to the field direction.

16. The method of claim 12, wherein the mount step includes aligning each of the contacts along a contact longitudinal axis that extends away from a plane containing the substrate.

17. The method of claim 12, further comprising: shaping the electrical contact to include a base portion and knee portion aligned within a common contact plane.

18. A method of forming an electrical contact, comprising:

mounting a plurality of electrical contacts on a substrate; and induction heating the electrical contacts for a predetermined period of time to heat different first and second portions of each of the electrical contacts by different first and second amounts, wherein said induction heating step heats the first portion of each of the electrical contacts such that the first portion exhibits superior strength properties as compared to the second portion.

19. A method of forming an electrical contact, comprising:

mounting a plurality of electrical contacts on a substrate; and induction heating the electrical contacts for a predetermined period of time to heat different first and second portions of each of the electrical contacts by different first and second amounts, wherein said induction heating step heats the second portion such that the second portion exhibits superior stress-relaxation properties as compared to the first portion.

20. A method for fabricating a contact component, comprising:

mounting a plurality of contacts onto a substrate, said substrate being insensitive to magnetic fields; and induction heating of each said contacts by different first and second amounts without induction heating said substrate, wherein said induction heating step heats a first portion of each of the electrical contacts such that the first portion exhibits superior strength properties as compared to a second portion of each of the electrical contacts.

21. A method for fabricating a contact component, comprising:

mounting a plurality of contacts onto a substrate, said substrate being insensitive to magnetic fields; and induction heating of each said contacts by different first and second amounts without induction heating said substrate, wherein said induction heating step heats a second portion of each of the electrical contacts such that the second portion exhibits superior stress-relaxation properties as compared to a first portion of each of the electrical contacts.

* * * * *